US005555933A

United States Patent [19]

Darragh et al.

[11] Patent Number: 5,555,933

[45] Date of Patent: Sep. 17, 1996

[54] PRIMARY SURFACE HEAT EXCHANGER FOR USE WITH A HIGH PRESSURE RATIO GAS TURBINE ENGINE

[75] Inventors: Charles T. Darragh, San Diego; Leonard Holman, Chula Vista; Thomas M. Luckett, San Diego; Michael E. Ward, Poway, all of Calif.

[73] Assignee: Solar Turbines Incorporated, San Diego, Calif.

[21] Appl. No.: 274,879

[22] Filed: Jul. 14, 1994

[51] Int. Cl.[6] ..... F28F 3/08

[52] U.S. Cl. ..... 165/166; 165/DIG. 356

[58] Field of Search ..... 165/166, 167

[56] References Cited

U.S. PATENT DOCUMENTS

| | | | |
|---|---|---|---|
| 4,346,582 | 8/1982 | Bailey | 72/379 |
| 4,434,637 | 3/1984 | Bailey | 72/17 |
| 4,911,235 | 3/1990 | Andersson et al. | 165/167 |
| 5,033,537 | 7/1991 | Atkin et al. | 165/32 |
| 5,081,834 | 1/1992 | Darragh | 60/39.511 |

*Primary Examiner*—Allen J. Flanigan
*Attorney, Agent, or Firm*—Larry G. Cain

[57] ABSTRACT

Prior art recuperators or heat exchangers have been restricted in use to only part speed and power application when adapted for use with high pressure gas turbine engine. The present recuperator or heat exchanger has been adapted for use with a high pressure ratio gas turbine engine. The recuperator includes a plurality of air cells being formed by a plurality of primary surface sheets. The primary surface sheets define a first surface and a second surface and has a plurality of corrugations formed therein. Each of the plurality of corrugations has a crest and a root extending from the respective first surface and second surface a preestablished axial distance. The preestablished axial distance from the crest to the first surface being unequal to that of the preestablished axial distance from the root to the second surface.

11 Claims, 3 Drawing Sheets

PRIMARY SURFACE HEAT EXCHANGER FOR USE WITH A HIGH PRESSURE RATIO GAS TURBINE ENGINE

TECHNICAL FIELD

This invention relates generally to a heat exchanger having a plurality of sheets so constructed as to control the availability of adequately opened flow paths for the efficient passage of heat exchanged media, donor and recipient fluids, therethrough.

BACKGROUND ART

Primary surface heat exchangers have been developed which incorporate thin alloy metal sheets, such as stainless steel that have been corrugated or folded in the nature of pleating. Heat, from a donor fluid, is transferred directly through the sheets to a recipient fluid. The sheets are suitably welded together around their peripheries to prevent the mixture of the donor and the recipient fluids. The corrugations in the sheets serve to support adjacent sheets in a stacked array forming an air cell of a heat exchanger assembly.

Before the sheets are stacked in the air cell, the edge portions of each sheet are crushed or flattened between dies to provide a flat transition or header sections. These transition sections are positioned at each end of the individual sheets and when stacked in the air cell receive the media and deliver the fluid to the appropriate passages formed on both sides of each sheet.

An example of the one such stacked plate heat exchangers of the type described is illustrated in U.S. Pat. No. 4,352,393 to Gonzalo D. Vidal-Meza on Oct. 5, 1982. The transition sections extend generally transversely to the corrugations, and the corrugations are flattened along a central plane. Other examples of flattening along a central plane are disclosed in U.S. Pat. No. 4,346,582 to John M. Bailey on Aug. 31, 1982 and U.S. Pat. No. 4,434,637 to John M. Bailey on Mar. 6, 1984.

When two primary sheets are laid together to form the air cell, the crushed areas form a manifold area. Opposite manifold areas are created within air cells to provide entry and exit of hot exhaust gasses, donor fluid, and cold air, recipient fluid. When heat exchangers or recuperators are used with high pressure ratio gas turbine engine, above about 10 to 1, the density of the air on the cold side, recipient fluid, increases resulting in an increase in the imbalance in fluid densities. While the recuperator is intended to be an energy saving device when used with the gas turbine engine, the donor and recipient fluid flowing through the recuperator losses pressure head. The net effect of this pressure head is a loss in developed power of high pressure gas turbine engines. Therefore, the minimization of the pressure head loss is desirable.

The present invention is directed to overcome one or more of the problems as set forth above.

DISCLOSURE OF THE INVENTION

In one aspect of the invention, a recuperator is adaptable for use with an engine and includes a plurality of air cells. The air cells are comprised of a plurality of primary surface sheets defining a first surface and a second surface. The sheets further have a heat transfer portion, a pair of end portions and a pair of transition portions. A donor spacer bar is attached to the first surface of one of the pair of transition portions and a recipient spacer bar is attached to the second surface of the other one of the pair of transition portions. The plurality of primary surface sheets have a plurality of corrugations formed therein. Each of the plurality of corrugations have a crest extending a preestablished axial distance above the first surface and a root extending a preestablished axial distance below the second surface. The preestablished axial distance above the first surface and the preestablished axial distance below the second surface is unequal.

BEST MODE FOR CARRYING OUT THE INVENTION

Figure 1:
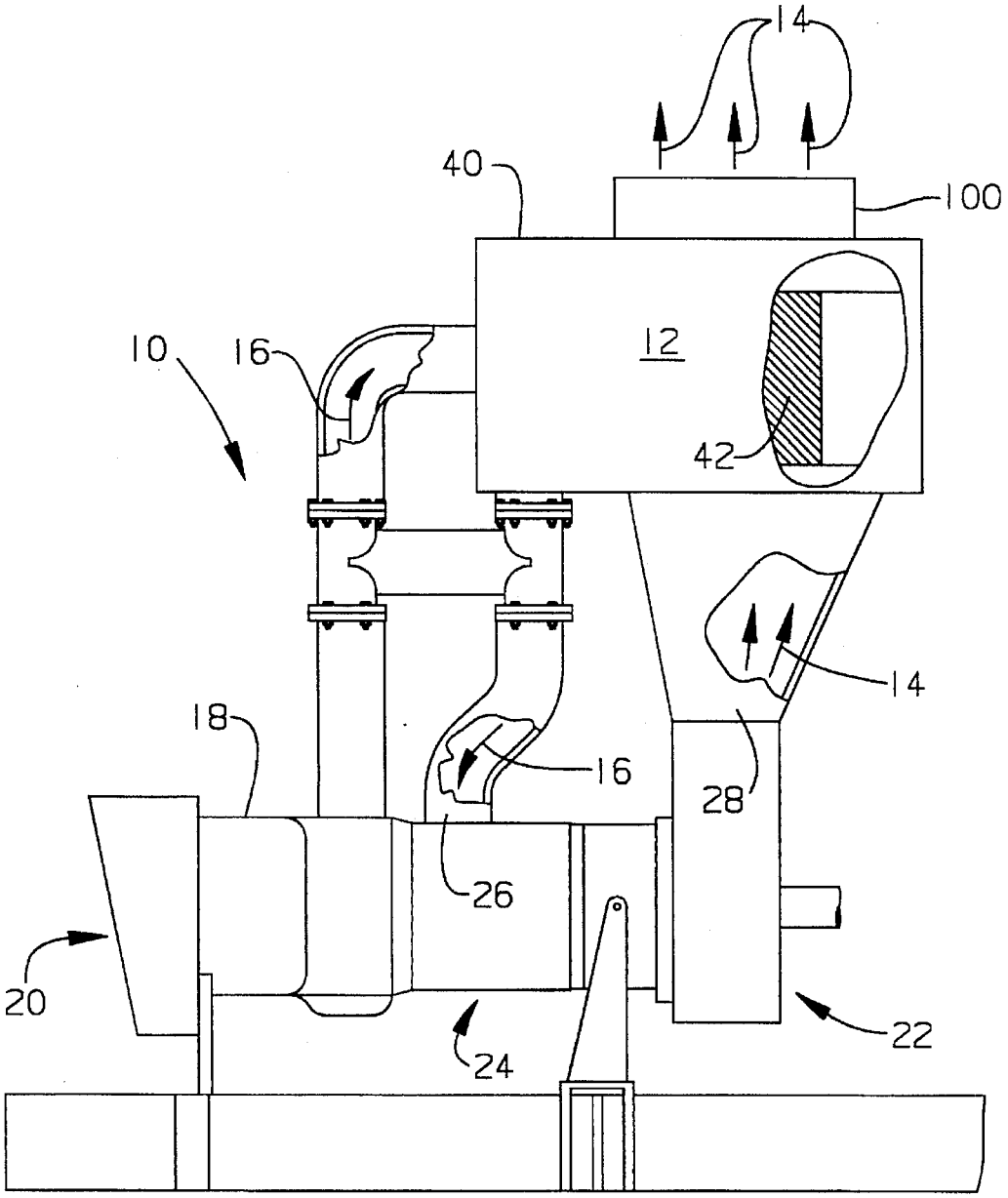
FIG. 1 is a partial side view of a gas turbine engine having a heat exchanger attached thereto embodying the present invention with portions sectioned for illustration convenience.

Referring to FIG. 1, a gas turbine engine 10 is shown. The gas turbine engine 10 is of the high pressure or high temperature type and has a pressure ratio of above about 10 to 1. A heat exchanger or recuperator 12 is removably attached to the gas turbine engine 10 in a conventional manner and during operation has a donor fluid, indicated by the arrows 14, and a recipient fluid, indicated by the arrows 16 passing therethrough. As an alternative, the recuperator or heat exchanger 12 can be used in any application wherein todays conventional recuperator or heat exchanger is desired. The gas turbine engine 10 includes an outer housing 18 having a compressor section 20, a turbine section 22 and a combustor section 24 positioned within the outer housing 18. The compressor section 20 is operatively connected to the recuperator 12 and, in operation, communicates the recipient fluid 16 to the recuperator 12. The combustor section 24 has an inlet portion 26 being in communication with the recuperator 12 in a conventional manner so that the recipient fluid 16 after passing through the recuperator 12 is communicated to the inlet portion 26 of the combustor section 24. The turbine section 22 has an outlet portion 28 being in communication with the recuperator 12 in a conventional manner so that during operation the donor fluid 14 is in communicated with the recuperator 12.

Figure 2:
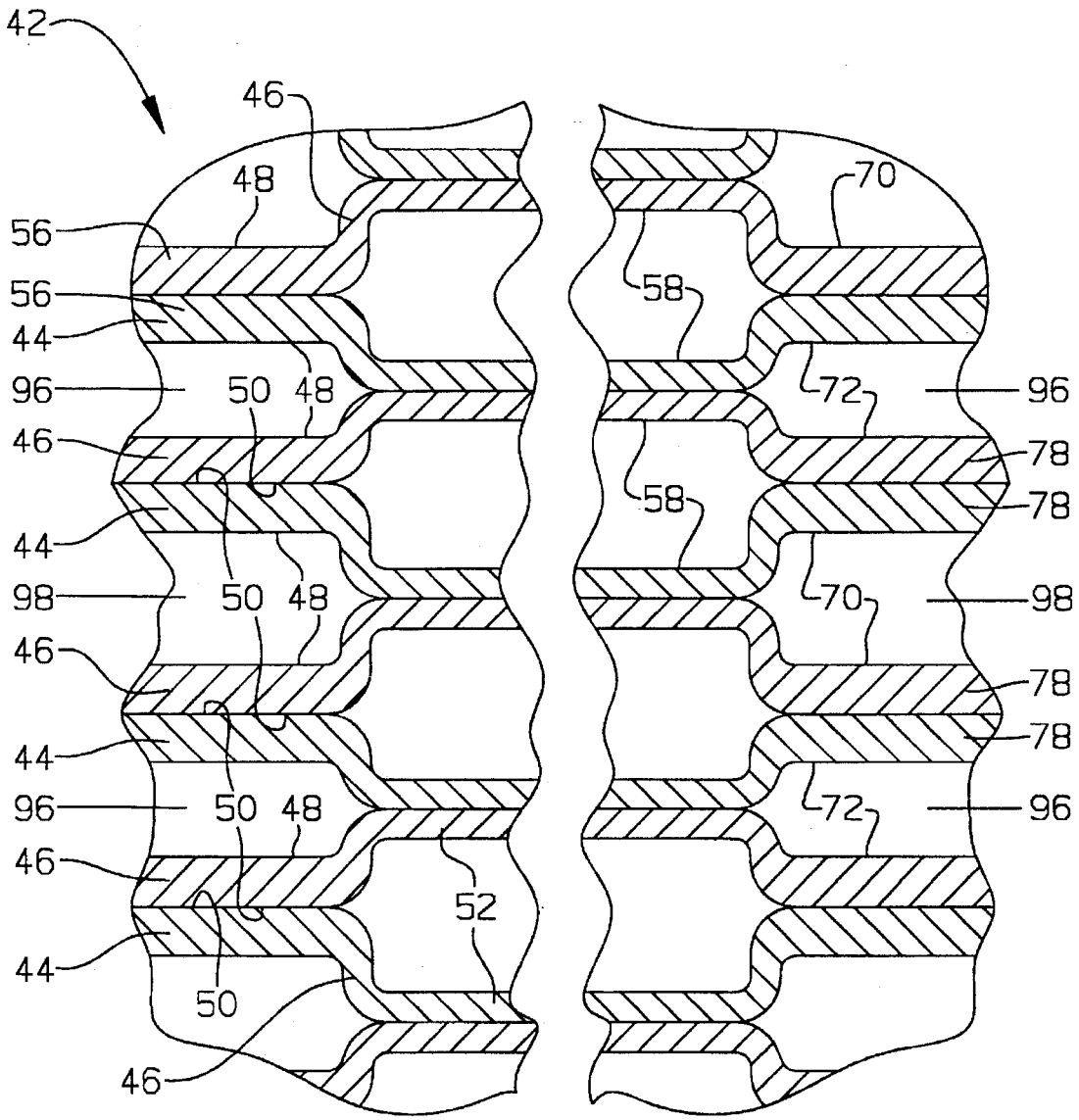
FIG. 2 is an enlarged sectional view of a portion of an air cell with a portion of the heat exchanger sheets assembled therein.
Figure 3:
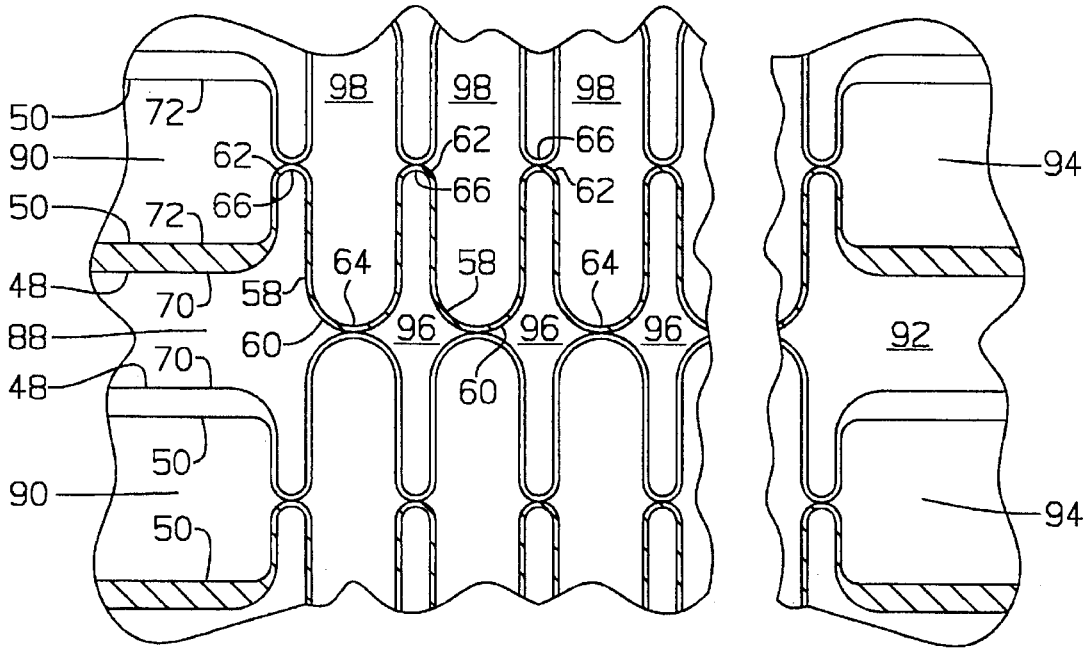
FIG. 3 is an enlarged sectional view of an air cell having a plurality of nonuniformly spaced pleats therein as taken along line 3 of FIG. 2.
Figure 4:
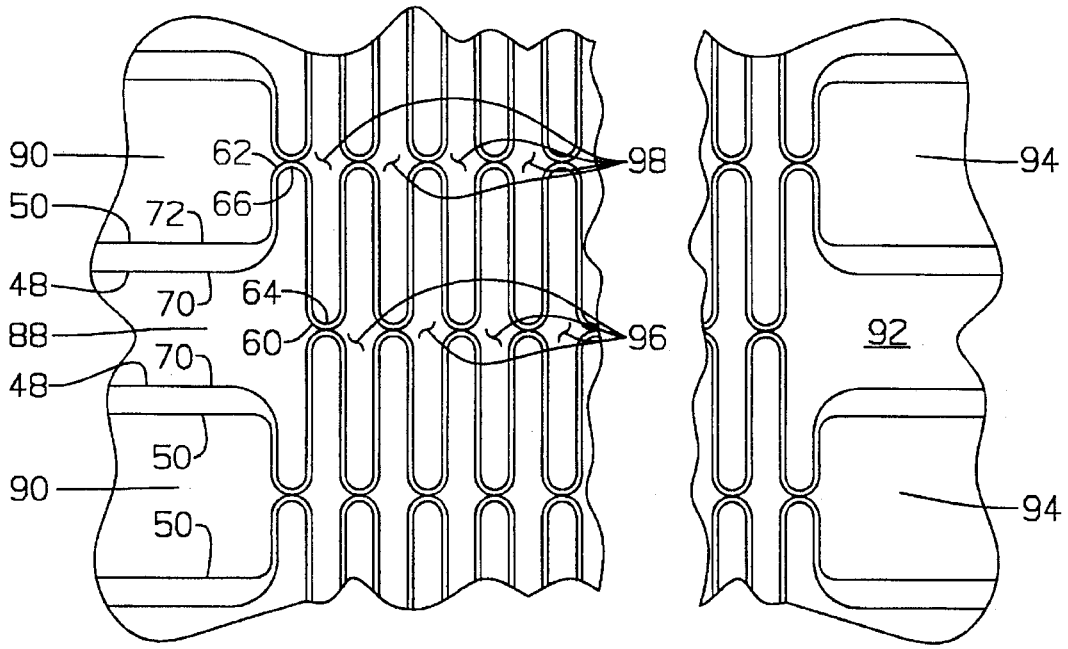
FIG. 4 is an enlarged sectional view of an alternative air cell having a plurality of uniformly spaced pleats therein.

The heat exchanger or recuperator 12 includes an outer shell 40 having a heat exchanger assembly 42 therein. As shown in FIGS. 2 and 3, the heat exchanger assembly 42 includes a plurality of air cell 44 being joined one to another in a conventional manner. Each of the air cells 44 includes a primary surface sheet 46 being made of heat transferring material and having a material thickness in the range of about two to eight mills. A first surface 48 and a second surface 50 are defined on each primary surface sheet 46. The sheet 46 includes a primary heat transfer portion 52 having a generally rectangular configuration, a pair of end portions, not shown, defined thereon and a pair of transition portions 56 attached to the primary heat transfer portion 52 intermediate the pair of end portions. In this application the entire primary surface sheet 46 is folded forming a plurality of corrugations 58 each having a crest 60 and a root 62. An extremity of the crest 60 is formed by a radiused outer portion 64 of the crest 60 and an extremity of the root 62 is formed by a radiused outer portion 66 of the root 62. In this application, the radiused outer portion 64 of the crest 60 is equal to about a 0.03 inch (0.8 mm) radius and the radiused outer portion 66 of the root 62 is equal to about a 0.01 inch (0.3 mm) radius. Thus, the radius of the crest 60 is about 3 times as large as the radius of the root 62. As an alternative, shown in FIG. 4, the radiused outer portion 64,66 of the respective crest 60 and the root 62 could be equal. The crests 60 extend a preestablished axial distance above the first surface 48 and the roots 62 extend a preestablished axial distance below the second surface 50. The pair of transition portions 56 are crushed laying the folds over, to create a thinner cross section in the transition portions 56. In this application, the position for crushing is axially offset between the crests 60 and the roots 62. For example, in this application the overall axial distance between the corresponding crests 60 and roots 62 is about 0.10 inches (2.5 mm). In forming the pair of transition portions 56 on the sheet 46, the pair of transition portions 56 are off-set axially between the crests 60 and the roots 62. For example, in this application, the axial distance between the crests 60 and a first surface 70 formed on each of the pair of transition portions 56 is about 0.04 inches (1.0 mm) and the axial distance between the roots 62 and a second surface 72 formed on the side opposite the first surface 70 of the pair of transition portions 56 is about 0.03 (0.8 mm) and the axial distance between the first surface 70 and the second surface 72 of the pair of transition portions 56 is about 0.06 inches (1.5 mm). Attached to a portion of the first surface 70 of one of the pair of transition portions 56 is a gas or donor spacer bar, of conventional design, not shown. Attached to a portion of the second surface 72 of the other one of the pair of transition portions 56 is an air or recipient spacer bar, of conventional design, not shown. In this application, each of the donor spacer bars and the recipient spacer bars is welded to the primary surface sheet 46 and form a sheet assembly 78. In forming each of the plurality of air cells 44, the sheet assemblies 78 are positioned one on top of another. The crests 60 of one of the sheet assembly 78 is placed in contacting relationship with the crests 60 of the other sheet assembly 78. As another sheet assembly 78 is placed in position to the first pair of sheet assemblies 78 the roots 62 of the sheet assemblies 78 are placed in contacting relationship. Thus, a donor inlet gallery 90 having a preestablished cross sectional area is formed between the second surfaces 72 of the corresponding sheet assemblies 78 at one of the corresponding pair of transition portions 56 and a recipient inlet gallery 88 having a preestablished cross sectional area is formed between the first surfaces 70 at the other of the corresponding pair of transition portions 56. A donor outlet gallery 94 having a preestablished cross sectional area is formed between the second surfaces 72 of corresponding pair of transition portions 56 at the end opposite the donor inlet gallery 90. A recipient outlet gallery 92 having a preestablished cross sectional area is formed between the first surfaces 70 of corresponding pair of transition portions 56 at the end opposite the recipient inlet gallery 88. In this application, the cross sectional area of the donor inlet gallery 90 is about 1.5 times larger than the cross sectional area of the recipient inlet gallery 88. A plurality of donor passages 98 extends between the donor inlet gallery 90 and the donor outlet gallery 94. The donor passages 98 are defined generally within a portion of the plurality of corrugations 58 between the crests 60, as best shown in FIG. 3. A plurality of recipient passages 96 extends between the recipient inlet gallery 88 and the recipient outlet gallery 92. The recipient passages 96 are defined generally within a portion of the plurality of corrugations 58 between the roots 62, as best shown in FIG. 3. In this application, the recipient fluid passage 96 has a preestablished cross sectional area and the donor fluid passage 98 has a preestablished cross sectional area being larger than the cross sectional area of the recipient fluid passage 96. The cross sectional area of the donor inlet gallery 90 and the donor outlet gallery 94 is generally equal. The cross sectional area of the recipient inlet gallery 88 and the recipient outlet gallery 92 is generally equal.

The outlet portion 28 of the turbine section 22 is in communication with the donor inlet gallery 90; the donor inlet gallery 90 is in communication with the plurality of donor passages 98; the plurality of donor passages 98 are in communication with the donor outlet gallery 94 and the donor outlet gallery 94 is in communication with an exhaust outlet 100. The compressor section 20 is in communication with the recipient inlet gallery 88; the recipient inlet gallery 88 is in communication with the plurality of recipient passages 96; the plurality of recipient passages 96 are in communication with the recipient outlet gallery 92 and the recipient outlet gallery 92 is in communication with the inlet portion 26 of the combustor section 24.

INDUSTRIAL APPLICABILITY

In use, the high compression ratio gas turbine engine 10 is started and allowed to warm up and is used in any suitable power application. As the demand for load or power is increased, the engine 10 output is increased by increasing the fuel and subsequent air resulting in the temperature within the engine 10 increasing. In this application, as the need for additional air increases the recipient fluid 16 increases in flow rate and in density. As the compression ratio of the gas turbine engine 10 increases above about 10 to 1 the transition portions 56 of the air cell 44 is crushed or flattened at an off-set position to compensate for the increase in the pressure head. The off-set position forms a larger area through which the lower pressure donor fluid 14 can flow; the offset position also forms a smaller area through which the higher pressure recipient fluid 16 cam flow; thus, balancing the pressure head or pressure losses of the two, donor and recipient, fluid. When using compressors having a pressure ratio of about less than 10 to 1 the size or area relationship between the plurality of donor passages 96 and the plurality of recipient passages 98 can remain generally equal.

The donor fluid 14 exits the outlet portion 28 of the turbine section 22 and is communicated to the donor inlet gallery 90. The donor fluid 14 passes freely through the donor inlet gallery 90 and enters the plurality of donor passages 98 passing therethrough and heating the plurality of corrugations 58 in which the donor fluid 14 comes in contact therewith. After giving up a portion of the donor fluid's heat, the donor fluid passes through the plurality of donor passages 98 and the donor fluid 14 exits through the donor outlet gallery 94 to the exhaust outlet 100.

With the off-set crush, the efficiency of the high compression ratio gas turbine engine 10 is improved throughout the entire speed and power range of the engine 10. For example, the highly compressed recipient fluid 16 exiting the compressor section 20 enters the recipient inlet gallery 88, which due to the off-set crush, has a smaller area than that of a conventional recipient inlet gallery and freely passes therethrough. Furthermore, due to the recipient fluid 16 being denser than that of a lower compression ratio engine's recipient fluid, the decrease in size of the plurality of recipient passages 88 still allows the recipient fluid to pass rather freely through the plurality of recipient passages 88. While passing through the plurality of recipient passages 98, the recipient fluid 16 absorbs heat from the plurality of corrugations 58 which have been heated by the donor fluid 14. The recipient fluid 16 exits the plurality of recipient passages 98 and enter into the recipient outlet gallery 92 which also utilizes the effects of the off-set crush to balance the pressure head loss of the two fluids, donor and recipient 14,16.

The result being that the heated recipient fluid 14 is preheated and can be used more efficiently within the gas turbine's combustion system.

The off-set crush provides a larger area for lower pressure donor fluid 14 to more efficiently pass. The results being a more efficiently operable high pressure gas turbine engine 10 under all speeds and power ranges of the engine 10. The combination of the off-set crush and the non-uniform area of the plurality of donor passages 98 compared to the area of the plurality of recipient passages 96 functionally makes use of a heat exchanger or recuperator during all speeds and power ranges of a high pressure gas turbine engine 10 feasible and efficient.

Other aspects, objects and advantages of this invention can be obtained from a study of the drawings, the disclosure and the appended claims.

We claim:

1. A recuperator including a plurality of air cells, said air cells comprising:

a plurality of primary surface sheets having a heat transfer portion, a pair of end portions and a pair of transition portions defining a first surface and a second surface;

said plurality of primary surface sheets having a plurality of corrugations formed therein, each of said plurality of corrugations having a crest extending a preestablished axial distance above the first surface and a root extending a preestablished axial distance below the second surface, said preestablished axial distance above the first surface and the preestablished axial distance below the second surface being unequal.

2. The recuperator of claim 1 wherein said crest of the plurality of corrugations has a preestablished radiused outer portion and said root of the plurality of corrugations has a preestablished radiused outer portion being larger than that of the preestablished radiused outer portion of the crest.

3. The recuperator of claim 2 wherein said preestablished radiused outer portion of the root is equal to about three times the preestablished radiused outer portion of the crest.

4. The recuperator of claim 1 wherein said crest of the plurality of corrugations has a preestablished radiused outer portion and said root of the plurality of corrugations has a preestablished radiused outer portion being equal to that of the preestablished radiused outer portion of the crest.

5. The recuperator of claim 1 wherein each of said plurality of air cells includes a recipient inlet gallery having a preestablished cross sectional area and a donor inlet gallery having a preestablished cross sectional area; said cross sectional area of the donor inlet gallery being about 1.5 time larger than the cross sectional area of the recipient inlet gallery.

6. The recuperator of claim 1 wherein said plurality of corrugations are formed on the entire first and second surfaces of each of the plurality of primary surface sheets.

7. The recuperator of claim 6 wherein said pair of transition portions have the plurality of corrugations crushed thereon.

8. The recuperator of claim 1 wherein said plurality of air cells include a donor fluid passage and a recipient fluid passage formed therein.

9. The recuperator of claim 8 wherein said donor fluid passage has a preestablished cross sectional area and said recipient fluid passage has a preestablished cross sectional area being smaller than that of the preestablished cross sectional area of the donor fluid passage.

10. The recuperator of claim 9 wherein said donor fluid passage is in communication with a donor inlet gallery and a donor outlet gallery and said recipient fluid passage is in communication with a recipient inlet gallery and a recipient outlet gallery.

11. The recuperator of claim 10 wherein said cross sectional area of the recipient inlet gallery and the recipient outlet gallery is smaller than the cross sectional area of the donor inlet gallery and the donor outlet gallery respectively.

* * * * *